US011572255B2

(12) United States Patent
Kashiwakura

(10) Patent No.: US 11,572,255 B2
(45) Date of Patent: Feb. 7, 2023

(54) DOOR LOCK OPERATION MEMBER FOR ELEVATOR DOOR LOCK DEVICE

(71) Applicant: FUJITEC CO., LTD., Hikone (JP)

(72) Inventor: Hiroshi Kashiwakura, Hikone (JP)

(73) Assignee: FUJITEC CO., LTD., Hikone (JP)

( * ) Notice: Subject to any disclaimer, the term of this patent is extended or adjusted under 35 U.S.C. 154(b) by 44 days.

(21) Appl. No.: 17/229,033

(22) Filed: Apr. 13, 2021

(65) Prior Publication Data

US 2021/0316962 A1 Oct. 14, 2021

(30) Foreign Application Priority Data

Apr. 14, 2020 (JP) ..... JP2020-072136

(51) Int. Cl.
*B66B 13/20* (2006.01)

(52) U.S. Cl.
CPC ..... *B66B 13/20* (2013.01)

(58) Field of Classification Search
CPC ..... B66B 13/12; B66B 13/20
See application file for complete search history.

(56) References Cited

U.S. PATENT DOCUMENTS

2016/0130116 A1 5/2016 Kitazawa

FOREIGN PATENT DOCUMENTS

| | | | | | |
|---|---|---|---|---|---|
| CN | 104760871 | A | * | 7/2015 | |
| JP | H7206335 | A | | 8/1995 | |
| JP | 6541046 | B1 | * | 7/2019 | ..... B66B 13/08 |
| KR | 101665338 | B1 | * | 10/2016 | |
| KR | 200482807 | Y1 | * | 3/2017 | |
| WO | 2015008386 | A1 | | 1/2015 | |
| WO | WO-2018138896 | A1 | * | 8/2018 | ..... B66B 13/12 |
| WO | WO-2019080582 | A1 | * | 5/2019 | ..... B66B 13/02 |

* cited by examiner

*Primary Examiner* — Diem M Tran
(74) *Attorney, Agent, or Firm* — The Webb Law Firm

(57) ABSTRACT

Provided is a door lock operation member for elevator door lock device for operating an elevator door lock device, the elevator door lock device including an interlock and a car door lock, the interlock being configured to lock the movement of a landing door in the opening direction when the landing door is in a closed state, the car door lock being configured to lock the movement of a car door in the opening direction when the car door is in a closed state. The door lock operation member further includes a lock operation part configured to actuate both the interlock and the car door lock in association with movements of the car door in the opening direction and in the closing direction.

2 Claims, 5 Drawing Sheets

DOOR LOCK OPERATION MEMBER FOR ELEVATOR DOOR LOCK DEVICE

CROSS-REFERENCE TO RELATED APPLICATION

This application claims priority to Japanese Patent Application No. 2020-072136 filed Apr. 14, 2020, the disclosure of which is hereby incorporated by reference in its entirety.

BACKGROUND OF THE INVENTION

Field of the Invention

The present invention relates to a door lock operation member for elevator door lock device configured to operate an interlock and a car door lock, the interlock being configured to switch a lock state of a landing door between the state in which it restricts the movement of the landing door in the opening direction and the state in which it releases the restriction in association with opening and closing of a car door, the car door lock being configured to switch a lock state of the car door between the state in which it restricts the movement of the car door in the opening direction and the state in which it releases the restriction.

Description of Related Art

Conventionally, a modernization is performed to replace a part of the elevator equipment with a new one (JP H7-206335 A). In the modernization performed herein, a car and a cam member configured to operate the interlock in association with the movements of the car door in the opening direction and the closing direction are replaced, while a landing floor and an interlock that locks the movement of a landing door in the opening direction are left unchanged.

In the modernization, a new equipment that was not installed in an existing elevator is retrofitted in some cases. Specifically, a car door lock for locking the movement of the car door in the opening direction is retrofitted to the existing elevator in some cases.

In this case, the cam member as aforementioned is unable to operate the car door lock, which causes a problem that troublesome works are necessitated to introduce an additional equipment for operating the car door lock separately from the car door lock.

SUMMARY OF THE INVENTION

In view of such circumstances, it is therefore an object of the present invention to provide a door lock operation member for elevator door lock device, which is capable of minimizing the troublesome works when a car provided with a car door lock is newly introduced to a landing floor having an interlock left unchanged.

For improving the basic understanding on some features of the invention of the present application, a brief summary of the present invention will be described below. This summary does not show the outline of the present invention, and is not intended to specify the main or important features of the present invention or to limit the scope of the present invention. The purpose thereof is only to provide some of basic concepts of the invention in a simplified style as a premise of the subsequent detailed description of the invention.

According to a door lock operation member for elevator door lock device for operating an elevator door lock device of the present invention, the elevator door lock device includes an interlock and a car door lock, the interlock including:

a landing-side base fixed at a position in a landing floor;

a landing-side engaging part mounted to a landing door and configured to be vertically moved to switch between an engaging state in which the landing-side engaging part engages with the landing-side base from a door closing side and an engagement releasing state in which the landing-side engaging part is released from engagement with the landing-side base; and a landing-side operation part configured to move the landing-side engaging part toward one side in a vertical direction upon pressing operation toward a door opening side of the landing door to release the landing-side base and the landing-side engaging part from engagement with each other, and to move the landing-side engaging part toward the other side in the vertical direction upon releasing of the pressing operation to bring the landing-side base and the landing-side engaging part into engagement with each other, the car door lock including:

a car-side base fixed to a car; and a car-side engaging part mounted to a car door and configured to be vertically moved to switch between a state of being engageable with a portion on a door closing side of the car-side base when the car door is in the movement in an opening direction and a state of being non-engaging with the portion on the door closing side of the car-side base when the car door is in the movement in a closing direction, the door lock operation member including:

a lock operation part configured to be arranged on the door closing side of the car door at a position away from the landing-side operation part and to be arranged opposed to the landing-side operation part when the car door is in a closed state, wherein the lock operation part is connected to the car-side engaging part and configured to move toward the door closing side and move upward upon pressing operation toward the door closing side, and move toward the opening side and move downward upon releasing the pressing operation toward the door closing side.

The door lock operation member for elevator door lock device according to the present invention may further include:

a holding mechanism arranged on the door opening side of the car door at a position away from the landing-side operation part and configured to be switched into a state of being held in contact with the landing-side operation part, before the switching of the movement of the car door in the opening direction to the movement of the car door in the closing direction after the start of the movement of the car door in the opening direction.

The door lock operation member for elevator door lock device according to the present invention may further include:

a restriction structure that restricts the lock operation part, which has moved toward the door closing side of the car door and upward, from moving toward the door closing side of the car door, wherein the lock operation part includes an elongated operation plate vertically extending and arranged with a plate surface of the operation plate facing the opening and closing direction of the car door, the restriction structure includes a first support configured to support both ends in the vertical direction of the operation plate from the closing side, and a second support configured to support a central portion in the vertical direction of the operation plate from the closing side, and the supporting positions at which the first support supports the both ends of the operation plate differ from the supporting position at which the second support supports the central portion of the operation plate relative to the inner and outer direction of an entrance of the car.

BRIEF DESCRIPTION OF DRAWINGS

The aforementioned features and the other features of the present invention will be clarified by the following description and figures illustrating the embodiments of the present invention.

DESCRIPTION OF THE INVENTION

Hereinafter, a door lock operation member for elevator door lock device (hereinafter referred to as a door lock operation member) according to an embodiment of the present invention will be described with reference to the attached drawings.

Figure 1:
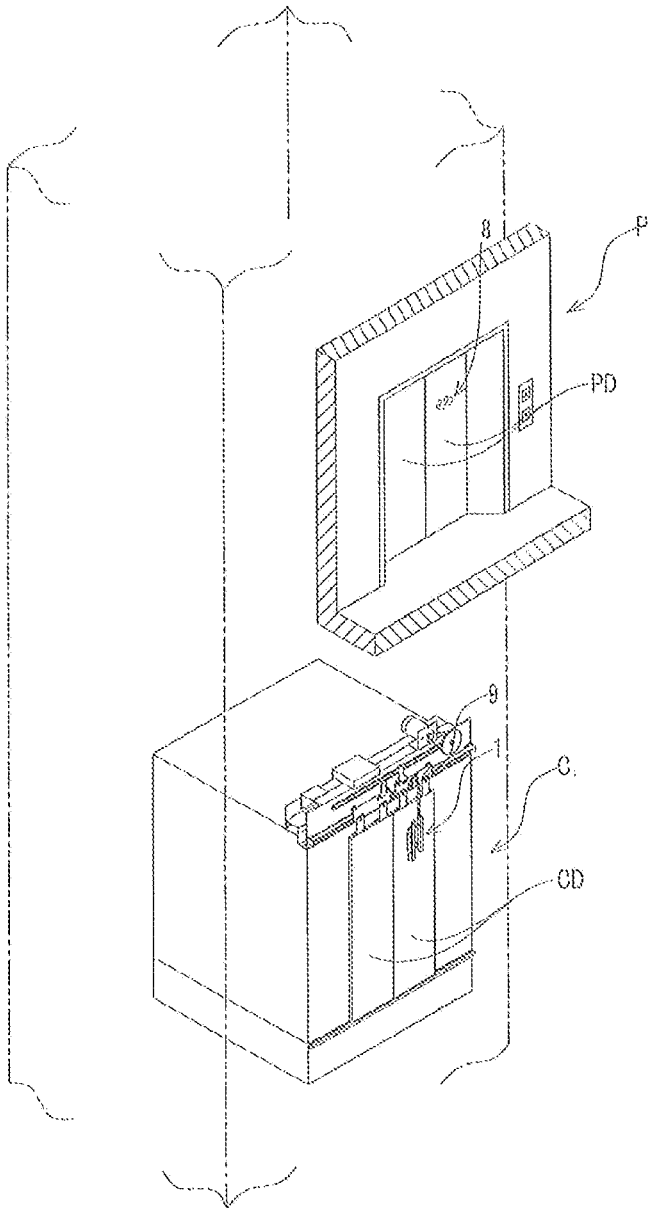
FIG. 1 is an entire schematic view of an elevator, to which a door lock operation member for elevator door lock device according to an embodiment of the present invention is mounted.

As shown in FIG. 1, a door lock operation member 1 according to this embodiment constitutes an elevator door lock device in cooperation with an interlock 8 that restricts the movement of a landing door PD in the opening direction (see FIG. 2) and a car door lock 9 that restricts the movement of a car door CD in the opening direction. The door lock operation member 1 is configured to operate the interlock 8 and the car door lock 9, while being mounted to an outer surface of the car door CD.

In this embodiment, hereinafter, a direction in which the car door CD slides toward the opening side and closing side will be referred to as an opening and closing direction, and a direction orthogonal to the opening and closing direction and the vertical direction (i.e., the direction passing through an entrance of the car C) will be referred to as an inner and outer direction. The opening and closing direction of the car door CD and the opening and closing direction of the landing door PD are the same as each other, and thus the opening and closing direction of the car door CD is also meant to be the opening and closing direction of the landing door PD.

Among the opening and closing direction, a side in a direction in which the car door CD slides when the car door CD opens will be referred to as an opening direction side, and a side in a direction in which the car door CD slides when the car door CD closes will be referred to as a closing direction side. A side toward the outside of the car C through the entrance of the car C will be referred to as an outer side, and a side toward the inside of the car C through the entrance of the car C will be referred to as an inner side.

First, a description will be given on the interlock 8 and the car door lock 9.

Figure 2:
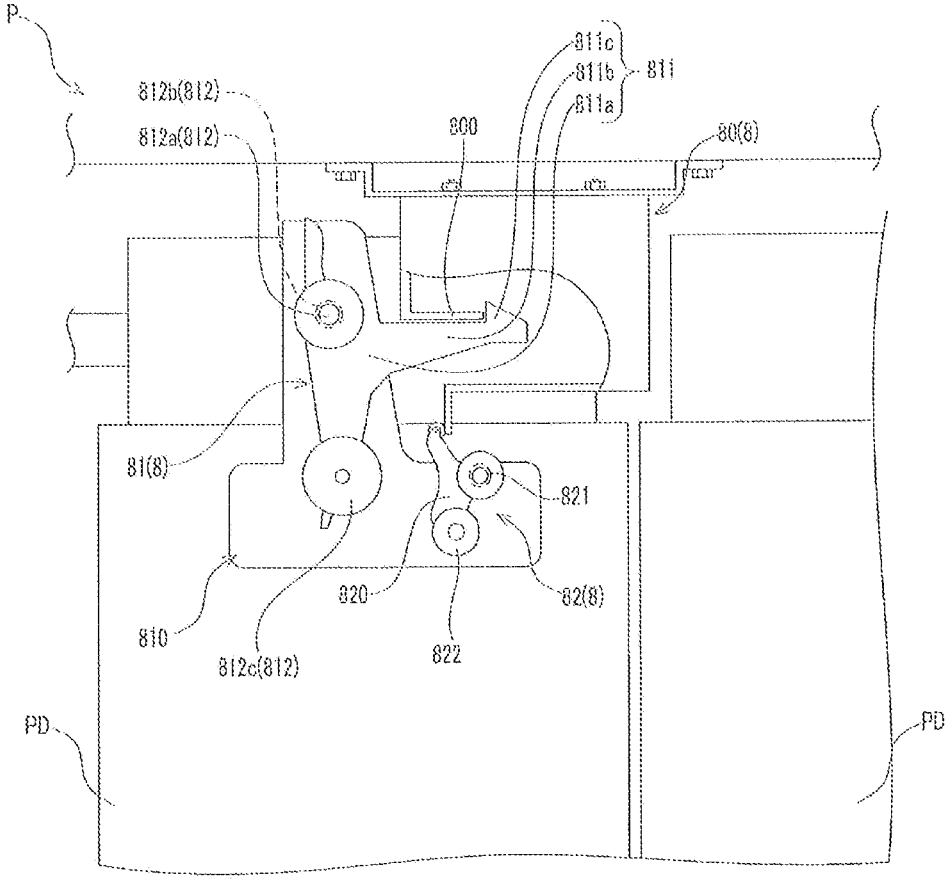
FIG. 2 is a front view of the landing floor for the elevator, to which the door lock operation member for elevator door lock device according to the embodiment is mounted, as viewed from the inside of an elevator shaft.

As shown in FIG. 2, the interlock 8 is configured to restrict the movement of the landing door PD from its closed state to the opened state, and release the restriction on the movement of the landing door PD in the opening direction in association with the movement of the car door CD in the opening direction. Also, the interlock 8 is configured to slide the landing door PD in association with the slide of the car door CD when it opens and closes.

The interlock 8 of this embodiment is mounted to the landing door PD and a landing-side base 80 that is fixed at a position in a landing floor P. The interlock 8 includes a landing-side engagement mechanism 81 that enables locking engagement relative to the door closing side of the landing-side base 80 when the landing door PD is in the closed state, and a pressed part 82 for door closing configured to be pressed toward the door closing side when the landing door PD closes.

The landing-side base 80 includes a landing-side engaged part 800 that enables locking engagement of a later-described landing-side claw 811*c* of the landing-side engagement mechanism 81 relative to the door closing side of the landing-side engaged part 800.

The landing-side engagement mechanism 81 includes an inside base 810 fixed to an inner surface of the landing door PD (i.e., a surface on the inner side), a landing-side engaging part 811 including the landing-side claw 811*c* configured to engage with the door closing side of the landing-side engaged part 800, and a landing-side operation part 812 configured to mount the landing-side engaging part 811 to the inner side of the inside base 810 and allow the landing-side engaging part 811 to pivotally move to thereby switch between the position at which the landing-side claw 811*c* is in engagement with the landing-side base 80 and the position at which the landing-side claw 811*c* is out of engagement with the landing-side base 80.

The inside base 810 has a plate shape and fixed to the landing door PD with one of its plate surfaces extending along the inner surface of the landing door PD.

The landing-side engaging part 811 includes a supported part 811*a* supported by a landing-side operation part 812 to be pivotally movable relative to the inside base 810, an arm part 811*b* extending from the supported part 811*a* to the closing side, and the landing-side claw 811*c* extending from the distal end to one side in the vertical direction (upper side in this embodiment), of the arm part 811*b*.

The supported part 811*a* is supported to be pivotally movable relative to the inside base 810. The pivot center of the supported part 811*a* is located on the door opening side of the landing-side engaged part 800.

The arm part 811*b* is configured such that the distal end of the arm part 811*b* is located on the door closing side of the landing-side engaged part 800 when the landing door PD is in a closed state. The landing-side claw 811*c* upwardly extends from the distal end of the arm part 811*b*.

The landing-side operation part 812 includes a landing-side pivot shaft 812*a* extending straight from the inside base 810 to the inner side and passing through the supported part 811*a*, a biasing member 812*b* configured to bias the supported part 811*a* toward one side in the circumferential direction about the landing-side pivot shaft 812*a*, and a pressed part 812*c* mounted to the supported part 811*a* and configured to be pressed toward the door opening side in the opening movement of the car door CD.

The position of the pressed part 812*c* in the vertical direction is set on the lower side of the landing-side pivot shaft 812*a*. The position of the pressed part 812*c* in the opening and closing direction is set on the door closing side of the landing-side pivot shaft 812*a*. The pressed part 812*c* of this embodiment is a roller configured to rotate about a rotation axis that extends straight from the supported part 811*a* to the inner side.

The pressed part 82 includes a pivotal part 820 for door closing that is mounted at a position on the door closing side of the pressed part 812*c* to be pivotally movable relative to the inside base 810, a biasing member 821 for door closing that is configured to bias the pivotal part 820 toward one side in the circumferential direction about the pivot center, and a pressed part 822 for door closing that is mounted to the pivotal part 820.

The biasing member 821 biases the pivotal part 820 to cause the pressed part 822 to move toward the door opening side. More specifically, the biasing member 821 biases the pivotal part 820 in a clockwise direction when the pivotal part 820 is viewed from the inner side.

The position of the pressed part 822 is set on the lower side of the pivotal part 820 and the biasing member 821.

The car door lock 9 is configured to restrict the opening movement of the car door CD, which is held in the closed state, and release the restriction on the opening movement of the car door CD in matching timing when the car door CD starts the opening movement.

Figure 3:
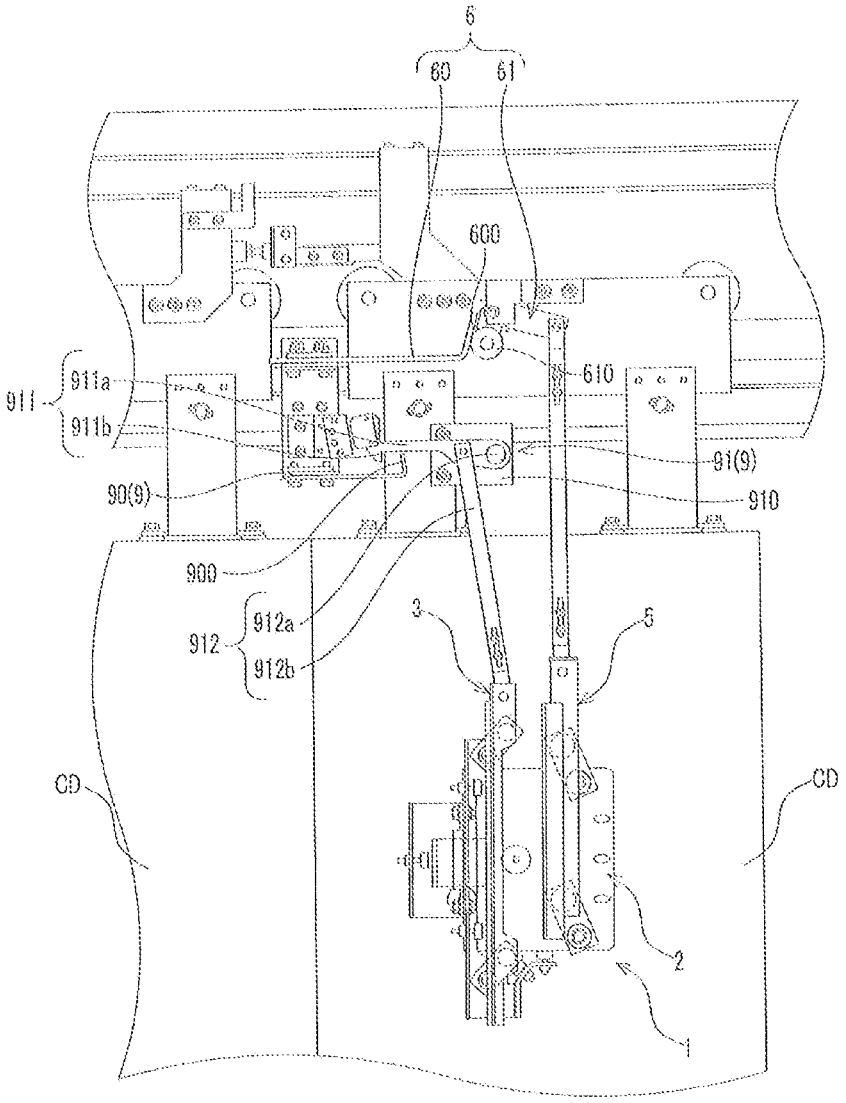
FIG. 3 is a front view of a car provided with the door lock operation member for elevator door lock device according to the embodiment as viewed from the outside of the car.

As shown in FIG. 3, the car door lock 9 includes a car-side base 90 fixed to the car C, and a car-side engagement mechanism 91 mounted to the car door CD and arranged opposite to the car-side base 90 at a position on the door closing side of the car-side base 90 (later-described interference section on a fixing side) when the car door CD is in the closed state.

The car-side base 90 includes an interference section 900 having an interference surface arranged to face the door closing side.

The car-side engagement mechanism 91 includes an outside base 910 fixed to an outer surface of the car door CD (i.e., a surface on the outer side), a car-side engaging part 911 including a car-side claw 911*b* that is arranged opposed to the interference section 900 at a position on the door closing side of the interference section 900, and a car-side pivot structure 912 configured to allow the car-side engaging part 911 to pivotally move in association with the movement of a lock operation part 3.

The car-side engaging part 911 has a plate shape and fixed to the car door CD with one of its plate surfaces extending along the outer surface of the car door CD.

The car-side engaging part 911 includes an arm part 911*a* having an elongated shape, and the car-side claw 911*b* downwardly extending from one end (distal end) of the arm part 911*a* in the longitudinal direction.

The car-side pivot structure 912 includes a car-side pivot shaft 912*a* extending straight from the outside base 910 to the outer side and passing through the other end (proximal end) of the arm part 911*a* in the longitudinal direction, and a link member 912*b* mounted between the distal end and the proximal end of the arm part 911*a* to link between the arm part 911*a* and the door lock operation member 1 (later-described lock operation part 3).

The car-side engaging part 911 is mounted to the outer side of the outside base 910 by the car-side pivot structure 912. Further, as the car-side engaging part 911 is pivotally moved about the car-side pivot shaft 912*a*, the car-side claw 911*b* and the interference section 900 of the car-side base 90 are switched between the state where they are positioned to face each other in the opening and closing direction to come into engagement with each other and the state where they are positioned not to face each other in the opening and closing direction to be out of engagement from each other.

The link member 912*b* of this embodiment has one end in the longitudinal direction pivotally connected between the distal end and the proximal end of the arm part 911*a* and the other end in the longitudinal direction pivotally connected to the lock operation part 3.

Figure 4:
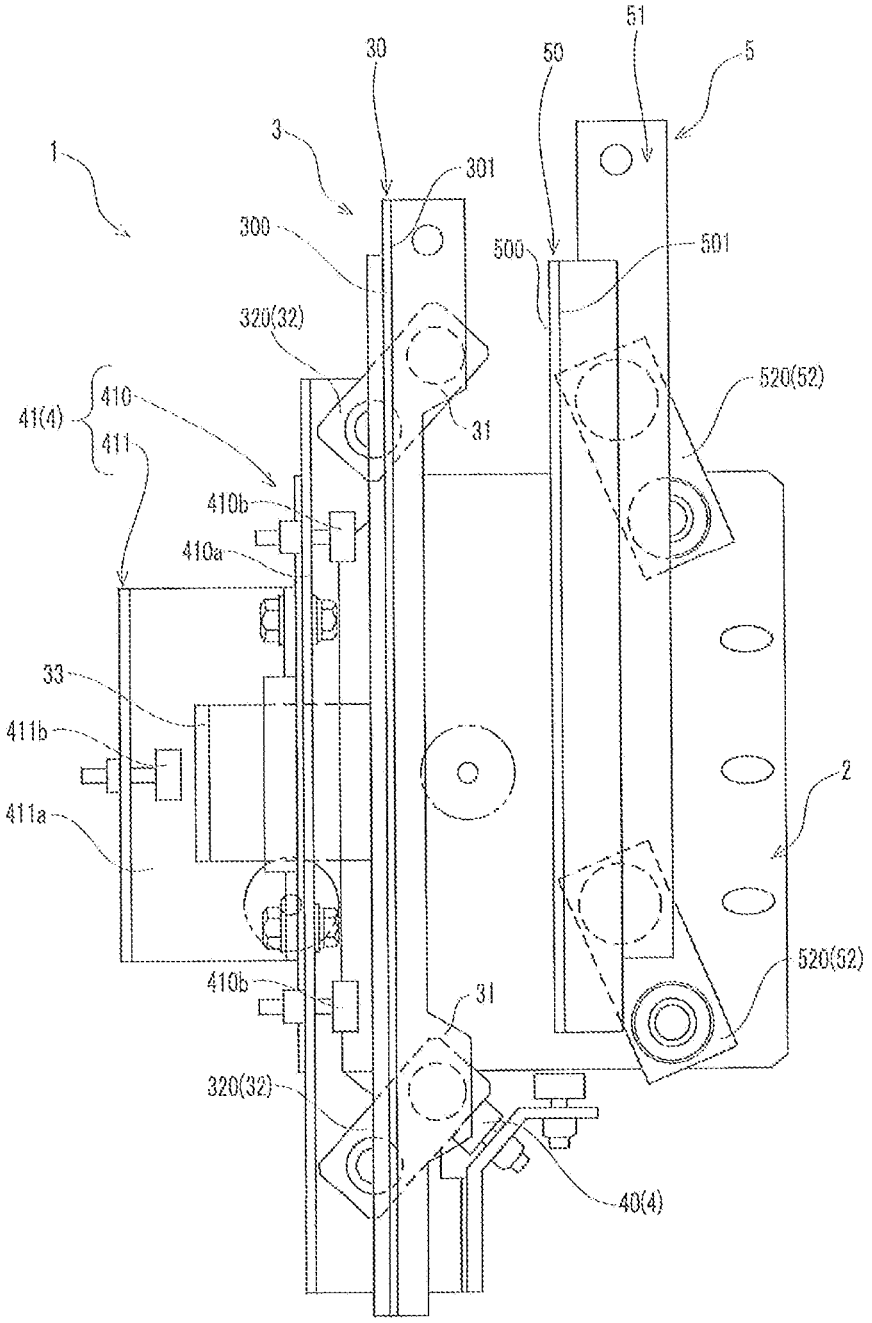
FIG. 4 is an enlarged view of the door lock operation member for elevator door lock device according to the embodiment.

As shown in FIG. 4, the door lock operation member 1 includes a locking side base 2 fixed to an outer surface of the car door CD (i.e., a surface on the outer side), the lock operation part 3 mounted to the locking side base 2 and configured to actuate the interlock 8 and the car door lock 9 (see FIG. 2 and FIG. 3), a movement restriction structure 4 that restricts the range of movement of the lock operation part 3, and a holding mechanism 5 configured to hold together with the lock operation part 3 the pressed part 812*c*.

In addition to the lock operation part 3, the movement restriction structure 4 and the holding mechanism 5 are mounted to the locking side base 2.

The lock operation part 3 includes an elongated operation plate 30 extending in the vertical direction and arranged with its plate surface facing the opening and closing direction of the car door CD, a pair of mounting plates 31 respectively continuous with the corresponding ends in the vertical direction of the operation plate 30 and arranged with their plate surfaces respectively facing the inner side and the outer side, a locking side pivotal connection mechanism 32 allowing the operation plate 30 to be pivotally connected to the locking side base 2.

A description will be hereinafter given on this embodiment, in which, among two plate surfaces of the operation plate 30, one surface arranged to face the door closing side is referred to as a closing-side facing surface 300, and the other surface arranged to face the door opening side is referred to as an opening-side facing surface 301.

The locking side pivotal connection mechanism 32 is a so-called link mechanism. The locking side pivotal connection mechanism 32 of this embodiment includes a pair of plate-shaped link plates 320. Each of the link plates 320 has an elongated shape and has one end in the longitudinal direction pivotally connected to the locking side base 2.

In one of the pair of link plates 320, the other end in the longitudinal direction is pivotally connected to the mounting plate 31 continuous with the upper end of the operation plate 30. In the other one of the pair of link plates 320, the other end in the longitudinal direction is pivotally connected to the mounting plate 31 continuous with the lower end of the operation plate 30.

When the operation plate 30 of the lock operation part 3 is applied with an external force directed to the door closing side, the other end side of each of the link plates 320 pivotally moves about the pivot center of the one end. At this time, the other end of each of the link plates 320 pivotally moves relative to the mounting plate 31. Thus, the operation plate 30 pivotally moves about the pivot center of the one end of the link plate 320, while having the closing-side facing surface 300 and the opening-side facing surface 301 directed to a certain direction.

The movement restriction structure 4 includes a restriction part (opening-side restriction part) 40 that restricts the lock operation part 3 from being pivotally moved toward the door opening side, and a restriction part (closing side restriction part) 41 that restricts the lock operation part 3 from being pivotally moved toward the door closing side.

The opening-side restriction part 40 is configured to determine the position (initial position) of the opening-side restriction part 40 when the car door CD is in a full closed state. The door opening side restriction part 40 of this embodiment is configured to receive the lower link plate 320 on its door opening side, the other end of which is being located on the door opening side and on the upper side of the one end of the lower link plate 320 when the car door CD is in the closed state.

The door closing side restriction part 41 includes a first supporting structure 410 that supports or receives both ends in the vertical direction (longitudinal direction) of the operation plate 30 on the door closing side of the operation plate 30 when the operation plate 30 has been pressed toward the door closing side, and a second supporting structure 411 that supports or receives a portion of the operation plate 30 between the upper and lower ends on the door closing side of the operation plate 30 when the operation plate 30 has been pressed toward the door closing side.

The first supporting structure 410 includes a first mount 410*a* that has an elongated shape and is arranged on the door closing side of the operation plate 30 with its posture parallel to the operation plate 30, and a pair of first supports 410*b* mounted to the first mount 410*a* with a distance from each other in the vertical direction.

The first mount 410*b* is integrally formed with the locking side base 2 and stands from the locking side base 2 toward the outer side.

One of the pair of first supports 410*b* is mounted to the first mount 410*a* at a position opposed to the upper end of the closing-side facing surface 300 of the operation plate 30. The other one of the pair of first supports 410*b* is mounted to the first mount 410*a* at a position opposed to the lower end of the closing-side facing surface 300 of the operation plate 30.

The second supporting structure 411 includes a second mount 411*a* extending from the lock operation part 3 toward the door closing side, and a second support 411*b* mounted to the second mount 411*a* at a position opposed to a central portion between the upper and lower ends of the closing-side facing surface 300 of the operation plate 30. The lock operation part 3 of this embodiment includes a received extension 33 extending from the central portion of the operation plate 30 toward the door closing side. The second support 411*b* is configured to receive the received extension 33.

The pair of first supports 410*b* differ from the second support 411*b* in their supporting positions relative to the inner and outer direction, at which they support the operation plate 30. The supporting positions at which the pair of first supports 410*b* support the operation plate 30 are set on the inner side of the supporting position at which the second support 411*b* supports the operation plate 30.

The holding mechanism 5 is arranged on the door opening side of the pressed part 812*c* and configured to be held out of contact with the pressed part 812*c* when the car door CD is in the closed state and to be switched into a state, in which the holding mechanism 5 is held in contact with the pressed part 812*c*, before the switching of the movement of the car door CD in the opening direction to the movement of the same in the closing direction after the start of the movement of the car door CD in the opening direction.

The holding mechanism 5 of this embodiment includes a hold plate 50 that has an elongated shape and is arranged on the door opening side of the pressed part 812*c* with its posture in the longitudinal direction conforming to the vertical direction, a connecting plate 51 that extends from the hold plate 50 toward the opening side and is connected to a cam mechanism 6 that is provided at the landing floor, and a holding-side pivotal connection mechanism 52 that allows the connecting plate 51 to be pivotally connected to the locking side base 2.

In this embodiment, a description will be hereinafter given in which, among two plate surfaces of the hold plate 50, one surface arranged to face the door closing side is referred to as a closing-side facing surface 500, and the other surface arranged to face the door opening side is referred to as an opening-side facing surface 501.

The holding-side pivotal connection mechanism 52 is a so-called link mechanism. The holding-side pivotal connection mechanism 52 of this embodiment includes a pair of plate-shaped link plates 520. Each of the link plates 520 has an elongated shape and has one end in the longitudinal direction pivotally connected to the locking side base 2.

In one of the pair of link plates 520, the other end in the longitudinal direction is pivotally connected to the upper end of the connecting plate 51. In the other one of the pair of link plates 520, the other end in the longitudinal direction is pivotally connected to the lower end of the connecting plate 51.

When the connecting plate 51 of the holding mechanism 5 is applied with a downward external force, the other end side of each of the link plates 520 pivotally moves about the pivot center at the one end. At this time, the other end of each of the link plates 520 is rotated relative to the connecting plate 51. Thus, the hold plate 50 is pivotally moved about the pivot center of the one end of the link plate 320, while having the closing-side facing surface 500 and the opening-side facing surface 501 respectively kept facing the same directions.

Herein, the cam mechanism 6 provided at the car C is configured to be actuated in association with the movements of the car door CD in the opening and closing directions as shown in FIG. 3. The cam mechanism 6 includes a rail 60 provided at the car C and extending in the opening and closing direction, a cam 61 configured to be pivotal relative to a door hanger.

One end on the door closing side of the rail 60 forms an inclined surface 600 inclined downward from the one end toward the door opening side.

A roller member 610 is mounted to the door closing side end of the cam 61, in which the door closing side end is located on the door closing side of a later-described pivot center serving as a reference point, and configured to be guided downward by the inclined surface 600 at the time of switching the car door CD from the opened state to the full closed state. Herein, the pivot center is a reference point, based on which the door closing side and the door opening side are defined.

The cam 61 of this embodiment includes, in addition to the roller member 610, a first plate member extending upward from the connecting plate 51 of the holding mechanism 5, and a second plate member that has a proximal end pivotally connected to an upper end of the first plate member and a distal end extending toward the door closing side. The pivotal center of the cam 61 is a pivotal center of the second plate member relative to the first plate member. The end on the door closing side with the pivotal center of the cam 61 serving as the reference point is herein the distal end of the second plate member.

Thereby, the cam 61 is configured to rotate at the time of switching the car door CD from the opened state to the full closed state to allow the door closing side end (i.e., the proximal end) of the cam 61 with the pivot center as the reference point to move upward. The hold plate 50 is connected to the door closing side end (i.e., the proximal end) of the cam 61, as described above. The hold plate 50, which is thereby kept pulled upward when the car door CD is in the closed state, is configured to pivotally move downward while moving toward the door closing side by its own weight as the car door CD starts to open, and, in association with the pivotal movement, press the pressed part 812*c* of the interlock 8 to the door opening side.

The door lock operation member 1 of this embodiment is configured as described above. Subsequently, a description will be given on the operation of the door lock operation member 1.

When the car door CD is in the full closed state, the car door lock 9 restricts the opening of the car door CD, while the interlock 8 restricts the opening of the landing door PD (see FIG. 3). When the car door CD starts the opening (i.e., the sliding toward the door opening side), the lock operation part 3 also moves toward the door opening side together with the car door CD.

When the car door CD with the lock operation part 3 being in contact with the pressed part 812*c* further continues opening, the lock operation part 3 is restricted from moving toward the door opening side, which allows the car door CD to keep moving toward the door opening side relative to the lock operation part 3. At this time, the lock operation part 3 pivotally moves upward about the one ends of the link plates 320, which causes the car-side engaging part 911 to move upward. Thereby, the car-side engaging part 911 and the car-side base 90 are brought into a state in which these members are unable to be engaged with each other even if the car door CD continues sliding toward the door closing side. That is, the restriction by the car door lock 9 on the movement of the car door CD toward the door opening side is released. Until the restriction by the car door lock 9 on the movement of the car door CD toward the door opening side is released, the landing door PD remains restricted from opening by the interlock 8.

Figure 5:
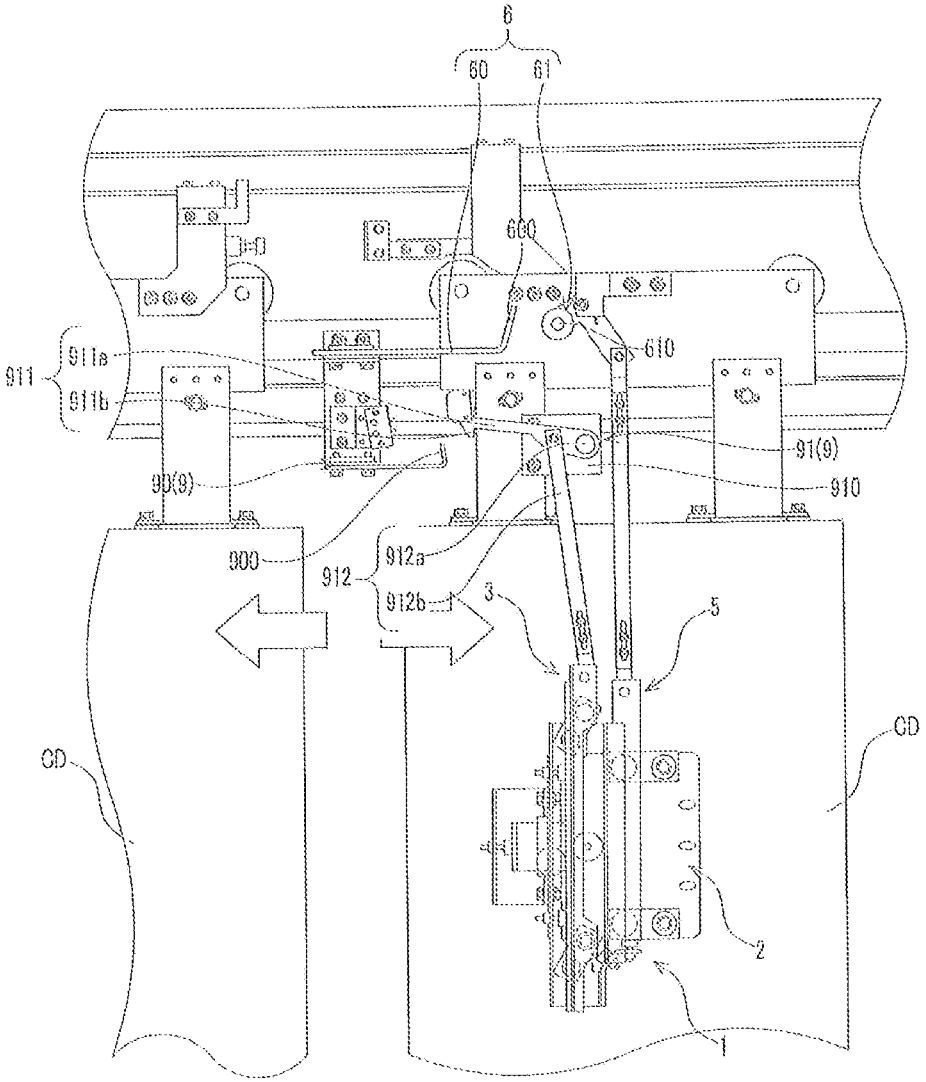
FIG. 5 is an explanatory view of the door lock operation member for elevator door lock device according to the embodiment in a state where a car door is opened.

In the state where the restriction by the car door lock 9 on the movement of the car door CD toward the door opening side is released, the lock operation part 3 is supported from the door closing side by the first support structure 410. Thus, when the car door CD further continues opening, the lock operation part 3 presses the pressed part 812*c* toward the door opening side. When the landing-side engaging part 811 is moved downward upon the pressing operation to the pressed part 812*c*, the engagement of the landing-side engaging part 811 with the landing-side base 80 is released, and thereby the restriction by the interlock 8 on the opening of the landing door PD is also released (see FIG. 5).

When the car door CD further moves in the opening direction, the roller member 610 of the cam 61 moves away from the inclined surface 600 of the rail 60. In association with this movement, the hold plate 50 is released from the state in which it is pulled upward by the cam mechanism 6, and therefore the hold plate 50 moves downward by its own weight. At this time, the hold plate 50 also moves toward the door closing side to come into contact with the pressed part 812*c*. Thereby, the operation plate 30 and the hold plate 50 together hold the pressed part 812*c* therebetween.

After the car door CD and the landing door PD are fully opened, the car door CD shifts from the movement in the opening direction to the movement in the closing direction. Then, the landing door PD also follows the car door CD to shift to the movement in the closing direction.

When the car door CD further moves to close, the lock operation part 3 moves together with the car door CD toward the door closing side to thereby move away from the pressed part 812*c*. In other words, the pressing on the pressed part 812*c* by the lock operation part 3 is released, and therefore the landing-side engaging part 811 moves upward to cause the landing-side engaging part 811 and the landing-side base 80 to be engaged with each other. Thereby, the landing door PD is again restricted from opening.

When the lock operation part 3 moves away from the pressed part 812*c*, the lock operation part 3 is released from pressing the pressed part 812*c* toward the door closing side to thereby move toward the door opening side while descending, and thereby the car-side engaging part 911 also descends so that the car-side engaging part 911 and the car-side base 90 are brought into a state in which they are engageable with each other in the opening and closing direction. Thereby, the car door CD is again restricted from opening.

As described above, according to the door lock operation member 1 of this embodiment, both the interlock 8 and the car door lock 9 can be operated by the lock operation part 3. Therefore, it is possible to eliminate troublesome works for separately installing the mechanism for operating the interlock 8 and the mechanism for operating the car door lock 9 when a car C equipped with the car door lock 9 is newly installed in an elevator with the landing floor P equipped with the existing interlock 8.

According to the door lock operation member 1, the function to operate the car door lock 9 mounted to the car C is added to the door lock operation member 1 configured to operate the interlock 8 mounted to the landing floor P. Thus, it is possible to produce an excellent effect of minimizing troublesome works for newly installing the car C equipped with the car door lock 9 in an elevator including the landing floor equipped with the existing interlock 8.

In the door lock operation member 1 of this embodiment, the operation plate 30 which is being pressed by the landing-side operation part 812 is supported by the first supports 410*b* and the second support 411*b* through the positions displaced from each other in the inner and outer direction, and thus can be prevented from being distorted or twisted.

Further, the holding mechanism 5 arranged on the door opening side of the car door CD at a position away from the landing-side operation part 812 is switched into the state, in which the holding mechanism 5 is held in contact with the pressed part 812*c*, before the switching of the movement of the car door CD in the opening direction to the movement of the same in the closing direction. This configuration can prevent a collision between the landing-side operation part 812 and the holding mechanism 5 when the closing of the car door CD closes. This configuration can also prevent occurrence of abnormal noise caused by the collision between the holding mechanism 5 and the landing-side operation part 812.

Although the door lock operation member for elevator door lock device of this embodiment is as described above, the present invention is not limited to the aforementioned embodiments and the design may be appropriately changed within the scope where the present invention is intended. Also, the functional effect of the present invention is not limited to the aforementioned embodiments. That is, the embodiments disclosed herein should be assumed as not limitations but exemplifications in all aspects. The scope of the present invention is described not by the above description but by the claims. Further, the scope of the present invention is intended to include the scope equivalent to the claims and all the changes in the claims.

Although not particularly mentioned, for example, the holding mechanism 5 in the aforementioned embodiment that is configured to cause the hold plate 50 and the operation plate 30 to hold the pressed part 812*c* therebetween before the switching of the movement of the car door CD in the opening direction to the movement of the same in the closing direction can more effectively prevent the landing door PD from loosening or rattling as the hold plate 50 and the operation plate 30 hold the pressed part 812*c* at an earlier timing.

What is claimed is:

1. A door lock operation member for elevator door lock device for operating an elevator door lock device, the elevator door lock device comprising an interlock and a car door lock, the interlock comprising:

a landing-side base fixed at a position in a landing floor;

a landing-side engaging part mounted to a landing door and configured to be vertically moved, while pivotally moving, to switch between an engaging state in which the landing-side engaging part engages with the landing-side base from a door closing side and an engagement releasing state in which the landing-side engaging part is released from engagement with the landing-side base; and a landing-side operation part configured to pivotally move the landing-side engaging part to thereby move the landing-side engaging part toward one side in a vertical direction upon pressing operation toward a door opening side of the landing door to release the landing-side base and the landing-side engaging part from engagement with each other, and configured to pivotally move the landing-side engaging part to thereby move the landing-side engaging part toward the other side in the vertical direction upon releasing of the pressing operation to bring the landing-side base and the landing-side engaging part into engagement with each other, the car door lock comprising:

a car-side base fixed to a car; and a car-side engaging part mounted to a car door and configured to be vertically moved to switch between a state of being engageable with a portion on a door closing side of the car-side base when the car door is in the movement in an opening direction and a state of being non-engaging with the portion on the door closing side of the car-side base when the car door is in the movement in a closing direction, the door lock operation member comprising:

a lock operation part configured to be arranged on the door closing side of the car door at a position away from the landing-side operation part and to be arranged opposed to the landing-side operation part when the car door is in a closed state, wherein the lock operation part is connected to the car-side engaging part and configured to move toward the door closing side and move upward upon pressing operation toward the door closing side, and move toward the opening side and move downward upon releasing the pressing operation toward the door closing side, and the door lock operation member further comprising:

a restriction structure that restricts the lock operation part, which has moved toward the door closing side of the car door and upward, from moving toward the door closing side of the car door, wherein the lock operation part comprises an elongated operation plate vertically extending and arranged with a plate surface of the elongated operation plate facing the opening and closing direction of the car door, the restriction structure comprises a pair of first supports configured to support both ends in the vertical direction of elongated the operation plate from the closing side, and a second support configured to support a central portion in the vertical direction of the elongated operation plate from the closing side, and supporting positions at which the pair of first supports support the both ends of the elongated operation plate differ from a supporting position at which the second support supports the central portion of the elongated operation plate relative to an inner and outer direction of an entrance of the car.

2. The door lock operation member for elevator door lock device according to claim 1, further comprising:

a holding mechanism arranged on the door opening side of the car door at a position away from the landing-side operation part and configured to be switched into a state of being held in contact with the landing-side operation part, before the switching of the movement of the car door in the opening direction to the movement of the car door in the closing direction after the start of the movement of the car door in the opening direction.

* * * * *